US009194061B2

(12) United States Patent
Hendriks et al.

(10) Patent No.: US 9,194,061 B2
(45) Date of Patent: Nov. 24, 2015

(54) PARA-ARAMID FIBRID FILM

(75) Inventors: Anton Johannes Josef Hendriks, Lent (NL); Dennis Wilbers, Arnhem (NL); Harrie Grotendorst, Duiven (NL); René Journee, Duiven (NL); Mirjam Ellen Oldenzeel, Westervoort (NL)

(73) Assignee: TEIJIN ARAMID B.V., Arnhem (NL)

( * ) Notice: Subject to any disclaimer, the term of this patent is extended or adjusted under 35 U.S.C. 154(b) by 1573 days.

(21) Appl. No.: 10/582,119

(22) PCT Filed: Nov. 30, 2004

(86) PCT No.: PCT/EP2004/013543
§ 371 (c)(1),
(2), (4) Date: Jun. 8, 2006

(87) PCT Pub. No.: WO2005/059247
PCT Pub. Date: Jun. 30, 2005

(65) Prior Publication Data

US 2007/0087178 A1 Apr. 19, 2007

(30) Foreign Application Priority Data

Dec. 9, 2003 (EP) ..... 03028090

(51) Int. Cl.
*D21H 13/26* (2006.01)
*D01F 6/60* (2006.01)

(52) U.S. Cl.
CPC ..... *D01F 6/605* (2013.01); *D21H 13/26* (2013.01); *Y10T 428/249924* (2015.04)

(58) Field of Classification Search
CPC ..... D21H 13/26; D01F 6/605; Y10T 428/249924
USPC ..... 442/327; 428/292.1
See application file for complete search history.

(56) References Cited

U.S. PATENT DOCUMENTS

| | | | | |
|---|---|---|---|---|
| 2,999,788 | A | 9/1961 | Morgan | |
| 3,018,091 | A * | 1/1962 | Duggins | 366/165.3 |
| 3,756,908 | A | 9/1973 | Gross | |
| 3,869,429 | A * | 3/1975 | Blades | 528/341 |
| 4,049,493 | A * | 9/1977 | Lare | 162/157.5 |
| 4,515,656 | A * | 5/1985 | Memeger, Jr. | 162/101 |
| 4,579,895 | A * | 4/1986 | Cuidard et al. | 524/104 |
| 4,785,038 | A | 11/1988 | Sweeny | |
| 4,842,924 | A * | 6/1989 | Farris et al. | 428/221 |
| 4,921,900 | A | 5/1990 | Van Trump | |
| 5,026,456 | A * | 6/1991 | Hesler et al. | 162/146 |
| 5,094,913 | A * | 3/1992 | Yang | 428/364 |
| 5,442,003 | A | 8/1995 | Takahashi et al. | |
| 5,474,842 | A * | 12/1995 | Hoiness | 428/327 |
| 5,523,034 | A * | 6/1996 | Lee | 264/9 |
| 5,679,758 | A | 10/1997 | Yang et al. | |
| 6,042,941 | A | 3/2000 | Krins et al. | |
| 6,120,643 | A * | 9/2000 | Levit | 162/141 |
| 6,143,819 | A * | 11/2000 | Nakanishi | 524/538 |
| 6,309,510 | B1 | 10/2001 | Kinsley, Jr. | |
| 2001/0006868 | A1 | 7/2001 | Kurumatani et al. | |

FOREIGN PATENT DOCUMENTS

| | | |
|---|---|---|
| EP | 0 302 377 A1 | 2/1989 |
| EP | 0 572 002 A2 | 12/1993 |
| JP | 06-041298 | 2/1994 |
| JP | 08-337920 | 12/1996 |
| JP | 10-001894 | 1/1998 |
| WO | WO 91/00272 | 1/1991 |

* cited by examiner

*Primary Examiner* — Peter Y Choi
(74) *Attorney, Agent, or Firm* — Oliff PLC

(57) ABSTRACT

A para-aramid fibrid film is disclosed that has at least 95% of the bonds of the polymer are para-oriented. A method for making said para-aramid fibrid film by (a) polymerizing a para-oriented aromatic diamine and a para-oriented aromatic dicarboxylic acid halide to an aramid polymer having only para-oriented bonds in a mixture of solvents consisting of N-methylpyrrolidone or dimethylacetamide and calcium chloride or lithium chloride to obtain a dope wherein the polymer is dissolved in the mixture of solvents and the polymer concentration is 2 to 6 wt. %, and (b) converting the dope to para-aramid fibrid film is also described.

19 Claims, No Drawings

PARA-ARAMID FIBRID FILM

CROSS-REFERENCE TO RELATED APPLICATION

The present application is a U.S. national stage application of PCT/EP2004/013543, filed Nov. 30, 2004, and claims priority to EP 03028090.3, filed Dec. 9, 2003 in Europe. The entire disclosures of the prior applications are each incorporated in its entirety herein by reference.

BACKGROUND

The present invention pertains to para-aramid fibrid film, to compositions containing the same, to a method for manufacturing the fibrid film, and to paper containing said fibrid film.

Aramid fibrids are known in the art. Thus in U.S. Pat. No. 3,756,908, the preparation of fibrids of aramid polymers with meta bonds was disclosed. These fibrids can be designed as meta-aramid fibrids and can be used in the process of paper making, preferably when combined with meta- or para-aramid pulp and meta- or para-aramid floc.

Fibrids are small, non-granular, non-rigid fibrous or film-like particles, wherein in films one of their dimensions is in the order of microns, and in fibers two dimensions are in the micron range. The term "fibrid" is well known in the art and clear to those skilled in the art. The skilled reader is further referred to U.S. Pat. No. 2,999,788 wherein a precise definition is given in which the term "fibrids" is further defined in that a fibrid particle must possess an ability to form a water-leaf. It further should have an ability to bond a substantial weight of staple fiber. The term "fibrid film" as used in this invention consistently satisfies the above definition for film-like particles, wherein the Canadian freeness number is between 40 and 790. The term "para" pertains to the aramid bonds of the polymer of which the fibrid is constituted.

Apart from U.S. Pat. No. 3,756,908, many other references are available describing meta-aramid fibrids. However, references describing para-aramid fibrids satisfying the hereinabove-given definition are not known.

Unfortunately, the term "para-aramid fibrid" sometimes is wrongly used to describe pulp, which is fibrillated and does not have a film-like structure, nor does it satisfy all the hereinabove given requirements. Thus, for instance, U.S. Pat. No. 6,309,510 mentions KEVLAR® fibrid. KEVLAR® is a trademark of DuPont for para-aramid. However, this material is highly fibrillated thus a pulp by definition. Another example of misuse of the term "fibrid" can be found in WO 91/00272 wherein Example 8 KEVLAR® PPTA fibrids are mentioned. It is clear from the context of this example and its head that fiber, not fibrids, are used. Note also that under the trade name KEVLAR® no fibrids are commercially available.

U.S. Pat. No. 4,921,900 is the only reference wherein it is not immediately clear whether the mentioned para-aramid fibrids are indeed fibrids. However, on repeating the examples of this reference, it appeared that the polymerization step does not lead to a clear solution and that coagulation of this solution results in polymer particles. Those particles did not satisfy the hereinabove-given definition of a fibrid. Moreover, the particles obtained contained a high content (60%) of fines.

Although para-aramid fibrid films according to the hereinabove-given definition never have been described, it was believed that such fibrids could have beneficial properties when used as replacement for the common meta-aramid fibrids. Particularly, improved paper properties were envisaged, in relation to strength, porosity, high temperature resistance, and moisture content. It was therefore an objective of the present invention to obtain methods for preparing para-aramid fibrid films, and also to obtain said prepared fibrid films and to products made thereof.

SUMMARY

To this end the invention relates to a para-aramid fibrid film, wherein at least 95% of the bonds of the polymer are para-oriented.

One dimension of the fibrid film is in the micrometer range, whereas the length and width are much greater, preferably having an average length of 0.2-2 mm and a width of 10-500 μm.

DETAILED DESCRIPTION OF EMBODIMENTS

It is further preferred that the fibrid films comprise less than 40%, preferably less than 30% of fines, wherein fines are defined as particles having a length weighted length (LL) less than 250 μm.

Para-oriented aramid (aromatic amide) is a condensation polymer of a para-oriented aromatic diamine and a para-oriented aromatic dicarboxylic acid halide (hereinafter abbreviated to "para-aramid"), and has hitherto been known to be useful in various fields such as fiber, pulp, and the like because of their high strength, high elastic modulus, and high heat resistance.

As used in the present invention, the term "para-aramid" means a substance obtained by a polycondensation of a para-oriented aromatic diamine and a para-oriented aromatic dicarboxylic acid halide of which recurring units have amide bonds at least 95% of which are located in the para-oriented or nearly para-oriented opposite positions of aromatic ring, namely in such coaxially or in-parallel arranged positions as those of para-phenylene, 4,4'-biphenylene, 1,5-naphthalene and 2,6-naphthalene. More preferably, at least 99% of the amide bonds are para oriented, and most preferably 100% of the bonds are para oriented.

Concrete examples of said para-aramid include the aramids of which structures have a poly-para-oriented form or a form close thereto, such as poly(para-phenylene terephthalamide), poly(4,4'-benzanilide terephthalamide), poly(paraphenylene-4,4'-biphenylenedicarboxylic acid amide) and poly(para-phenylene-2,6-naphthalenedicarboxylic acid amide). Among these para-aramids, poly(para-phenylene terephthalamide) (hereinafter abbreviated to PPTA) is most representative.

Examples of the para-oriented aromatic diamine usable in the present invention include para-phenylenediamine, 4,4'-diaminobiphenyl, 2-methyl-para-phenylenediamine, 2-chloro-para-phenylenediamine, 2,6-naphthalenediamine, 1,5-naphthalenediamine, and 4,4'-diaminobenzanilide.

Examples of para-oriented aromatic dicarboxylic acid halide usable in the present invention include terephthaloyl chloride, 4,4'-dibenzoyl chloride, 2-chloro-terephthaloyl chloride, 2,5-dichloroterephthaloyl chloride, 2-methyl-terephthaloyl chloride, 2,6-naphthalenedicarboxylic acid chloride, and 1,5-naphthalenedicarboxylic acid chloride.

Hitherto, PPTA has been produced in polar amide solvent/salt systems in the following manner. Thus, PPTA is produced by carrying out a solution polymerization reaction in a polar amide solvent. The PPTA is precipitated, washed with water and dried, and once isolated as a polymer. Then, the polymer is dissolved in a solvent and made into a PPTA fiber by the process of wet spinning. In this step, concentrated sulfuric acid is used as the solvent of spinning dope, because PPTA is not readily soluble in organic solvents. This spinning dope usually shows an optical anisotropy.

Industrially, PPTA fiber is produced from a spinning dope using concentrated sulfuric acid as a solvent, considering the performances as a long fiber, particularly strength and stiffness.

According to the prior art process, a meta-aramid fibrid is made by beating a liquid suspension of the shaped structures by an interfacial forming process, by adding a solution of a polymer to a precipitant for the polymer, or by using a fibridator, which is a rotor generating shear. Any method applying sufficient shear onto the polymer can also be used to make the para-aramid fibrid films of this invention.

Generally, methods for manufacturing the fibrid film of the invention comprise the steps:

a. polymerizing a para-oriented aromatic diamine and a para-oriented aromatic dicarboxylic acid halide to an aramid polymer having only para-oriented bonds in a mixture of solvents consisting of N-methylpyrrolidone or dimethylacetamide and calcium chloride or lithium chloride to obtain a dope wherein the polymer is dissolved in the mixture of solvents and the polymer concentration is 2 to 6 wt. %, and
b. converting the dope to para-aramid fibrid film by using conventional methods known for making meta-aramid fibrid.

It should be remarked that many polymerization processes for making para-aramid are known. However, none of these leads to para-aramid fibrid. Thus EP 572002 describes a process, which leads to pulp and fiber rather than to fibrid. This reference describes a different process than the present process, i.e., fibers are spun and thereafter pulp is produced in the common way by cutting the fiber to cut short fiber, which is subjected to a refining process thereafter. US 2001/0006868 describes making fiber chops, but these contain non-para oriented bonds (i.e., 3,4'-diphenylether units). In U.S. Pat. No. 6,042,941, polymerization is performed in sulfuric acid, in EP 302377 the polymerization is performed in DMSO, and also in U.S. Pat. No. 4,921,900 no para-aramid fibrid is formed as explained before.

In another embodiment of the invention, the polymerization is performed such that at least part of the hydrochloric acid formed is neutralized to obtain a neutralized dope.

In a particularly preferred embodiment, the dope is converted to para-aramid fibrid film by:

i. spinning the dope through a jet spin nozzle to obtain a polymer stream, hitting the polymer stream with a coagulant at an angle wherein the vector of the coagulant velocity perpendicular to the polymer stream is at least 5 m/s, preferably at least 10 m/s to coagulate the stream to para-aramid fibrid films, or
ii. coagulating the dope by means of a rotor stator apparatus in which the polymer solution is applied through the stator on the rotor so that precipitating polymer fibrids are subjected to shear forces while they are in a plastic deformable stage.

In the present invention, 0.950-1.050 mole, preferably 0.980-1.030, more preferably 0.995-1.010 mole of para-oriented aromatic diamine is used per 1 mole of para-oriented aromatic carboxylic acid halide in a polar amide solvent in which 0.5-4 wt. % of alkali metal chloride or alkaline earth metal chloride is dissolved (preferably 1-3 wt. %), making the concentration of para-aramid obtained thereof 2-6 wt. %, more preferably 3-4.5 wt. %. In the present invention the polymerization temperature of para-aramid is −20° C. to 70° C., preferably 0° C. to 30° C., and more preferably 5° C. to 25° C. In this temperature range, the dynamic viscosity is within the required range and the fibrid produced thereof by spinning can have sufficient degree of crystallization and degree of crystal orientation.

An important feature of the present invention is that the polymerization reaction may be first enhanced and thereafter stopped by neutralizing the polymer solution or the solution forming the polymer by adding an inorganic or strong organic base, preferably calcium oxide or lithium oxide. In this respect the terms "calcium oxide" and "lithium oxide" comprise calcium hydroxide and lithium hydroxide, respectively. This neutralization effects the removal of hydrogen chloride, which is formed during the polymerization reaction. Neutralization results in a drop of the dynamic viscosity with a factor of at least 3 (with regard to non-neutralized corresponding solution). Per mole of the amide group formed in the polycondensation reaction, after neutralization the chlorides are preferably present in an amount of 0.5-2.5 moles, more preferably in an amount of 0.7-1.4 moles. The total amount of chloride may originate from $CaCl_2$, which is used in the solvent and from CaO, which is used as neutralizing agent (base). If the calcium chloride content is too high or too low, the dynamic viscosity of the solution is raised too much to be suitable as a spin solution. The dope, and also the fibrid film products obtained thereof, are essentially free from inorganic ions other than $Ca^{2+}$, $Li^{+}$ and $Cl^{-}$ ions.

The liquid para-aramid polymerization solution can be supplied with the aid of a pressure vessel to a spinning pump to feed a nozzle for jet spinning of 100-1000 μm to fibrids. The liquid para-aramid solution is spun through a spinning nozzle into a zone of lower pressure. According to a preferred embodiment, jet spinning is performed by using a coagulant jet in the spinning nozzle, without using air for scattering the polymer stream. More preferably, the coagulant hits the polymer stream essentially perpendicularly. In another embodiment, air jet spinning is used at more than 1 bar, preferably 4-6 bar. Air is separately applied through a ring-shaped channel to the same zone where expansion of air occurs. Under the influence of the coagulant stream, the liquid spinning solution is converted to fibrid films. The coagulant is selected from water, mixtures of water, NMP and $CaCl_2$, and any other suitable coagulant. Preferred are mixtures of water, NMP and $CaCl_2$.

An objective of the invention is to provide compositions comprising the hereinbefore mentioned para-aramid fibrid.

Another objective of the present invention is to make improved paper by using compositions having at least 2% of the para-aramid fibrid films of this invention. Preferably at least 5%, more preferably at least 10% (by weight) of para-aramid fibrid film is used in papermaking compositions. Other components in such compositions are the usual pulp, floc, fiber, staple, fillers, inorganic fibers, and the like, which may contain para- and/or meta-aramid polymer, or any other suitable polymer for papermaking.

These and other objectives have been achieved by a process for making a para-aramid polymer solution comprising the steps of at least partially neutralizing the hydrochloric acid to obtain a solution wherein the dynamic viscosity is at least a factor three smaller than the dynamic viscosity of the polymer solution without neutralization, and wherein the p-aramid concentration in the solution is 2 to 6 wt. %. Neutralization may be performed during or after the polymerization reaction.

According to another embodiment of the invention, a non-fibrous neutralized polymer solution of para-aramid in a mixture of NMP/$CaCl_2$, NMP/LiCl, or DMAc/LiCl has been made, wherein the polymer has a relative viscosity $\eta_{rel}>2.2$.

Depending on the polymer concentration, the dope exhibits an anisotropic or an isotropic behavior. Preferably, the dynamic viscosity $\eta_{dyn}$ is smaller than 10 Pa·s, more preferably smaller than 5 Pa·s at a shear rate of 1000 $s^{-1}$. Neutralization, if performed, takes place during or preferably after polymerizing the monomers forming the para-aramid. The neutralization agent is not present in the solution of monomers before polymerization has commenced. Neutralization reduces dynamic viscosity by a factor of at least 3. The neutralized polymer solution can be used for direct fibrid film spinning using a nozzle, contacting the polymer stream by a coagulant or pressurized air in a zone with lower pressure where the polymer stream is broken and coagulated to fibrid films. When air is used, the polymer stream should thereafter be hit by a coagulant (preferably a mixture of water, NMP, and $CaCl_2$). Coagulation occurs at an angle wherein the vector of the coagulant velocity perpendicular to the polymer stream is at least 5 m/s, preferably at least 10 m/s to coagulate the stream to para-aramid fibrid films.

The para-aramid polymer solution of the present invention exhibits a low dynamic viscosity at a temperature up to about 60° C. in the shear rate range of 100-10,000 $s^{-1}$. For that reason the polymer solution according to the invention can be spun at a temperature below 60° C., preferably at room temperature. Further, the para-aramid dope of the present invention is free from an extra component as pyridine and can be produced advantageously from the industrial point of view in that the production process can be simplified and the process is free from the problem of corrosion of apparatuses by concentrated sulfuric acid as compared with the dopes using concentrated sulfuric acid as a solvent.

Further, according to the process of the present invention, the polymer solution can directly be spun, and the product can be made into a fibrid film directly, so that the process of production can be greatly simplified.

A para-aramid paper having very high paper strength (measured as a high tensile index) is already obtained before drying the paper by applying the para-aramid fibrid films of the invention. Such papers show further a very low porosity and low equilibrium moisture content. The fibrid films of the present invention are useful as a starting material for para-aramid paper, friction materials including automobile brake, various gaskets, E-papers (for instance for electronic purposes, as it contains very low amounts of ions compared to para-aramid pulp made from sulfuric acid solutions), and the like.

The present invention will now be explained by way of the following non-limitative examples.

The methods of test and evaluation and criteria of judgment employed in the examples and comparative examples were as follows.

Test Methods

Relative Viscosity

The sample was dissolved in sulfuric acid (96%) at room temperature at a concentration of 0.25% (m/v). The flow time of the sample solution in sulfuric acid was measured at 25° C. in an Ubbelohde viscometer. Under identical conditions the flow time of the solvent is measured as well. The viscosity ratio is then calculated as the ratio between the two observed flow times.

Dynamic Viscosity

The dynamic viscosity is measured using capillary rheometry at room temperature. By making use of the Powerlaw coefficient and the Rabinowitsch correction, the real wall shear rate and the viscosity have been calculated.

Fiber Length Measurement

Fiber length measurement was done using the PULP EXPERT™ FS (ex Metso). As length, the average length (AL), the length weighted length (LL), weight weighted length (WL) is used. The subscript 0.25 means the respective value for particles with a length >250 micron. The amount of fines was determined as the fraction of particles having a length weighted length (LL) <250 micron.

This instrument needs to be calibrated with a sample with known fiber length. The calibration was performed with commercially available pulp as indicated in Table 1.

TABLE 1

| Commercially available samples | AL mm | LL mm | WL mm | $AL_{0.25}$ mm | $LL_{0.25}$ mm | $WL_{0.25}$ mm | Fines % |
|---|---|---|---|---|---|---|---|
| A | 0.27 | 0.84 | 1.66 | 0.69 | 1.10 | 1.72 | 26.8 |
| B | 0.25 | 0.69 | 1.31 | 0.61 | 0.90 | 1.37 | 27.5 |
| C | 0.23 | 0.78 | 1.84 | 0.64 | 1.12 | 1.95 | 34.2 |

A KEVLAR ® 1F539, Type 979
B TWARON ® 1095, Charge 315200, 24-01-2003
C TWARON ® 1099, Ser. no. 323518592, Art. no. 108692

Specific Surface Area (SSA) Determination

Specific surface area ($m^2/g$) was determined using adsorption of nitrogen by the BET specific surface area method, using a Gemini 2375 manufactured by Micromeretics. The wet pulp samples were dried at 120° C. overnight, followed by flushing with nitrogen for at least 1 h at 200° C.

CSF Value Tappi 227

3 g (dry weight) never dried pulp is dispersed in 1 l of water during 1000 beats in a Lorentz and Wettre desintegrator. A well-opened pulp is obtained. The Canadian Standard Freeness (CSF) value is measured and corrected for slight differences in weight of the pulp (Tappi 227).

Paper Strength

Hand sheets (70 $g/m^2$) were made of 100% fibrid material or of 50% fibrid and 50% TWARON® 6 mm fiber (TWARON® 1000). Tensile index (TI) (Nm/g) was measured according to ASTM D828 and Tappi T494 om-96 on dried paper (120° C.), wherein sample width is 15 mm, sample length 100 mm, and test speed 10 mm/min at 21° C./65% RH conditions.

Evaluation of Optical Anisotropy (Liquid Crystal State)

Optical anisotropy is examined under a polarization microscope (bright image) and/or seen as opalescence during stirring.

EXAMPLE 1

Polymerization of para-phenyleneterephthalamide (PPTA) was carried out using a 160 L Drais reactor. After sufficiently drying the reactor, 631 of NMP/$CaCl_2$ (N-methylpyrrolidone/calcium chloride) with a $CaCl_2$ concentration of 2.5 wt. % was added to the reactor. Subsequently, 1487 g of para-phenylenediamine (PPD) was added and dissolved at room temperature. Thereafter the PPD solution was cooled to 10° C. and 2772 g of TDC was added. After addition of the TDC, the polymerization reaction was continued for 45 min. Then the polymer solution was neutralized with a calcium oxide/NMP-slurry (766 g of CaO in NMP). After addition of the CaO-slurry, the polymer solution was stirred for at least another 15 min. This neutralization was carried out to remove the hydrogen chloride (HCl), which is formed during polymerization. A gel-like polymer solution was obtained with a PPTA content of 4.5 wt. % and having a relative viscosity of 3.5 (in 0.25% $H_2SO_4$). The obtained solution exhibited optical anisotropy and was stable for more than one month. The solution was diluted with NMP until a polymer concentration of 3.6% was obtained.

The solution was spun through a jet spinning nozzle (spinning hole of 350 micron) at 5 kg/hour (room temperature). Water was added at 1400 l/hour through a ring-shaped channel under an angle in the direction of the polymer flow. Water velocity was 14 m/s. The fibrid was collected upon a filter and characterized having a $WL_{0.25}$ mm of 1.85 mm, fines content of 18% and a SSA of 2.11 $m^2/g$, CSF value of 330 mL. A paper consisting of 100% fibrid was made resulting in TI of 10.0 Nm/g.

| PULP EXPERT FS Example 1 | | | |
|---|---|---|---|
| $AL_{0.25}$ (mm) | $LL_{0.25}$ (mm) | $WL_{0.25}$ (mm) | Fines (%) |
| 0.69 | 1.11 | 1.85 | 18.3 |

EXAMPLE 2

Polymerization of para-phenyleneterephthalamide was carried out using a 160 L Drais reactor. After sufficiently drying the reactor, 631 of NMP/$CaCl_2$ (N-methylpyrrolidone/calcium chloride) with a $CaCl_2$ concentration of 2.5 wt. % was added to the reactor. Subsequently, 1506 g of para-phenylenediamine (PPD) was added and dissolved at room temperature. Thereafter the PPD solution was cooled to 10° C. and 2808 g of TDC was added. After addition of the TDC, the polymerization reaction was continued for 45 min. Then the polymer solution was neutralized with a calcium oxide/NMP-slurry (776 g of CaO in NMP). After addition of the CaO-slurry, the polymer solution was stirred for at least another 15 min. This neutralization was carried out to remove the hydrogen chloride (HCl), which is formed during polymerization. A gel-like polymer solution was obtained with a PPTA content of 4.5 wt. % and having a relative viscosity of 3.2 (in 0.25% $H_2SO_4$). The obtained solution exhibited optical anisotropy and was stable for more than one month. The solution was diluted with NMP until a polymer concentration of 3.6% was obtained.

The solution was spun through a jet spinning nozzle at 4.3 kg/hour. The nozzle had a 350 μm spinning nozzle. Air was blown through a ring-shaped channel with 5.9 $Nm^3/h$ (normal cube per hour) (7 bar) perpendicular to the polymer flow, water was thereafter added with 724 l/h through a ring-shaped channel under an angle in the direction of the polymer stream. Water velocity was 16 m/s. The fibrid was collected upon a filter and characterized having a $WL_{0.25}$ mm of 1.63 mm, fines content of 19% and a SSA of 3.6 $m^2/g$, CSF value of 215 mL.

| PULP EXPERT FS Example 2 | | | |
|---|---|---|---|
| $AL_{0.25}$ (mm) | $LL_{0.25}$ (mm) | $WL_{0.25}$ (mm) | Fines (%) |
| 0.67 | 1.04 | 1.63 | 19.4 |

EXAMPLE 3

Polymerization of para-phenyleneterephthalamide was carried out using a 2.5 $m^3$ Drais reactor. After sufficiently drying the reactor, 1140 l of NMP/$CaCl_2$ (N-methylpyrrolidone/calcium chloride) with a $CaCl_2$ concentration of 2.5 wt. % was added to the reactor. Subsequently, 27.50 kg of para-phenylenediamine (PPD) was added and dissolved at room temperature. Thereafter the PPD solution was cooled to 5° C. and 51.10 kg of TDC was added. After addition of the TDC, the polymerization reaction was continued for 45 min. Then the polymer solution was neutralized with a calcium oxide/NMP-slurry (14.10 kg of CaO in 281 NMP). After addition of the CaO-slurry, the polymer solution was stirred for at least another 15 min. This neutralization was carried out to remove the hydrogen chloride (HCl), which is formed during polymerization. A gel-like polymer solution was obtained with a PPTA content of 4.5 wt. % and having a relative viscosity of 2.2 (in 0.25% $H_2SO_4$). The solution was diluted with NMP until a polymer concentration of 3.1% was obtained. The obtained solution exhibited optical anisotropy and was stable for more than one month.

The solution was spun through a jet spinning nozzle (hole of 350 micron) at 25 kg/hour. Water was added through a ring-shaped channel flowing perpendicular to the polymer flow with 840 l/h. Water velocity was 30 m/s. The fibrid was collected upon a filter and characterized having a $WL_{0.25}$ mm of 1.09 mm, fines content of 28% and a SSA of 1.76 $m^2/g$, and a CSF value of 70 mL. A paper consisting of 100% fibrid was made resulting in a TI of 24 Nm/g. In case 50% TWARON® 1000 6 mm fiber was used and 50% fibrids a paper with a TI of 38 Nm/g was obtained.

| PULP EXPERT FS Example 3 | | | |
|---|---|---|---|
| $AL_{0.25}$ (mm) | $LL_{0.25}$ (mm) | $WL_{0.25}$ (mm) | Fines (%) |
| 0.56 | 0.77 | 1.09 | 28.1 |

EXAMPLE 4, 5, AND 6

Polymerization of para-phenyleneterephthalamide was carried out using a 2.5 $m^3$ Drais reactor. After sufficiently drying the reactor, 1145 l of NMP/$CaCl_2$ (N-methylpyrrolidone/calcium chloride) with a $CaCl_2$ concentration of 2.5 wt. % was added to the reactor. Subsequently, 27.10 kg of para-phenylenediamine (PPD) was added and dissolved at room temperature. Thereafter the PPD solution was cooled to 5° C. and 50.35 kg of TDC was added. After addition of the TDC, the polymerization reaction was continued for 45 min. Then the polymer solution was neutralized with a calcium oxide/NMP-slurry (13.90 kg of CaO in 28 l NMP). After addition of the CaO-slurry, the polymer solution was stirred for at least another 15 min. This neutralization was carried out to remove the hydrogen chloride (HCl), which is formed during polymerization. A gel-like polymer solution was obtained with a PPTA content of 4.5 wt. % and having a relative viscosity of 2.0 (in 0.25% $H_2SO_4$). The solution was diluted with NMP until a polymer concentration of 3.6% was obtained. The obtained solution exhibited optical anisotropy and was stable for more than one month.

Fibrids with different lengths were spun by using a 4 hole (350 □m) jet spin nozzle where NMP/$CaCl_2$/water (30 wt. %/1.5 wt %/68.5 wt. %) is flowing through ring-channels shaped channels perpendicular to the polymer flow. By changing the coagulant velocity (27-53 m/s) the length of the fibrids is changed. Papers were made from 50% TWARON® 1000 6 er and 50% fibrids. See Table 2 for fibrid and paper characteristics.

TABLE 2

| Example | Poly Flow (kg/h) | coag. flow (l/h) | coag. speed (m/s) |
|---|---|---|---|
| 4 | 77 | 360 | 27 |
| 5 | 77 | 430 | 32 |
| 6 | 77 | 540 | 40 |

| | PULP EXPERT FS | | | | | | |
|---|---|---|---|---|---|---|---|
| Example | $AL_{0.25}$ (mm) | $LL_{0.25}$ (mm) | $WL_{0.25}$ (mm) | Fines (%) | SSA ($m^2/g$) | CSF (mL) | TI Nm/g |
| 4 | 0.54 | 0.72 | 1.00 | 27.50 | 1.57 | 200 | 25 |
| 5 | 0.51 | 0.67 | 0.89 | 31.50 | 0.87 | 57 | 39 |
| 6 | 0.46 | 0.58 | 0.74 | 39.75 | 0.30 | 40 | 47 |

A PPTA solution in NMP/$CaCl_2$ was diluted to 3.1% (same solution as in Example 3). The relative viscosity was 2.2. The solution was added to a rotor stator coagulator. The data of the fibrids 7a and 7b (having the rotor speeds indicated in the table) are summarized in Table 3. A paper consisting of 100% fibrid was made resulting in TI's as indicated in Table 3.

TABLE 3

| | PULP EXPERT FS | | | | | | |
|---|---|---|---|---|---|---|---|
| EXAMPLE | $AL_{0.25}$ (mm) | $LL_{0.25}$ (mm) | $WL_{0.25}$ (mm) | Fines (%) | SSA ($m^2/g$) | CSF (mL) | TI Nm/g |
| 7a | 0.73 | 1.05 | 1.44 | 14.60 | 1.97 | 560 | 4.4 |
| 7b | 0.53 | 0.68 | 0.89 | 23.50 | 3.23 | 293 | 12 |

| | | |
|---|---|---|
| coagulator: | | Unitika |
| polymer solution flow: | | 60 g/hr. |
| coagulant flow: | | 1200 L/h |
| coagulant: | | water/NMP(20%)/$CaCl_2$(1%) |
| rotor speed: | Ex 7a | 3000 rpm |
| | Ex 7b | 5400 rpm |

The invention claimed is:

1. A para-aramid fibrid film-like particle, wherein at least 95% of the bonds of aramid of the para-aramid fibrid film-like particle are para-oriented, and, and wherein the para-aramid fibrid film-like particle is obtained by polymerizing a para-oriented aromatic diamine and a para-oriented aromatic dicarboxylic acid halide at 20° C. to 70° C. in a polar amide solvent, in which 0.5-4 wt. % of alkali metal chloride or alkaline earth metal chloride is dissolved, using 0.950-1.050 mol of the para-oriented aromatic diamine per mol of the para-oriented aromatic dicarboxylic acid halide, to obtain a dope of 2-6 wt. % of an aramid polymer having at least 95% para-oriented bonds; and converting the dope to the para-aramid fibrid film-like particle.

2. The para-aramid fibrid film-like particle of claim 1, wherein the aramid is poly(para-phenyleneterephthalamide).

3. The para-aramid fibrid film-like particle of claim 1, wherein the fibrid film-like particle has an average length of 0.2-2 mm and a width of 10-500 μm.

4. A composition comprising the para-aramid fibrid film-like particle of claim 1 and between about 0% to 40% of fines, wherein fines are defined as particles having a length weighted length (LL) less than 250 μm.

5. The para-aramid fibrid film-like particle of claim 1, wherein the fibrid film-like particle is substantially free from inorganic ions other than $Ca^{2+}$, $Li^{+}$ and $Cl^{-}$ ions.

6. A composition comprising the para-aramid fibrid film-like particle of claim 1.

7. A paper made of constituents comprising at least 2 wt. % of the para-aramid fibrid film-like particle of claim 1.

8. A method of manufacture of the para-aramid fibrid film-like particle of claim 1, comprising:

polymerizing a para-oriented aromatic diamine and a para-oriented aromatic dicarboxylic acid halide to an aramid having at least 95% para-oriented bonds in a mixture of solvents consisting of N-methylpyrrolidone or dimethylacetamide and calcium chloride or lithium chloride to obtain a dope wherein the aramid is dissolved in the mixture of solvents and the aramid concentration is 2 to 6 wt. %, and converting the dope to para-aramid fibrid film-like particles.

9. The method according to claim 8 wherein at least part of the hydrochloric acid formed in the method is neutralized to obtain a neutralized dope.

10. The method according to claim 8 wherein the dope is converted to para-aramid fibrid film-like particles by:

spinning the dope through a jet spin nozzle to obtain an aramid stream, hitting the aramid stream with a coagulant at an angle wherein the vector of the coagulant velocity perpendicular to the aramid stream is at least 5 m/s to coagulate the stream to para-aramid fibrid film-like particles, or coagulating the dope by means of a rotor stator apparatus in which the aramid solution is applied through the stator on the rotor so that precipitating para-aramid fibrid film-like particles are subjected to shear forces while they are in a plastic deformable stage.

11. The method according to claim 9 wherein the ηrel (relative viscosity) of the para-aramid is between 2.0 and 5.0.

12. A composition comprising the para-aramid fibrid film-like particle of claim 1 and between about 0% to 30% of fines, wherein fines are defined as particles having a length weighted length (LL) less than 250 μm.

13. A paper made of constituents comprising at least 5 wt. % of the para-aramid fibrid film-like particles of claim 1.

14. A paper made of constituents comprising at least 10 wt. % of the para-aramid fibrid film-like particles of claim 1.

15. The method according to claim 8 wherein the dope is converted to para-aramid fibrid film-like particles by:

spinning the dope through a jet spin nozzle to obtain an aramid stream, hitting the aramid stream with a coagulant at an angle wherein the vector of the coagulant velocity perpendicular to the aramid stream is at least 10 m/s to coagulate the stream to para-aramid fibrid film-like particles, or coagulating the dope by means of a rotor stator apparatus in which the aramid solution is applied through the stator on the rotor so that precipitating para-aramid fibrid film-like particles are subjected to shear forces while they are in a plastic deformable stage.

16. The para-aramid fibrid film-like particle of claim 1, wherein the particle has a Canadian freeness number of between 40 and 790.

17. The para-aramid fibrid film-like particle of claim 1, wherein the only polymers used to produce the para-aramid fibrid film-like particle are para-aramid.

18. The para-aramid fibrid film-like particle of claim 1, wherein the para-aramid fibrid film-like particle consists of a para-aramid obtained by polycondensation of a para-oriented aromatic diamine and a para-oriented aromatic dicarboxylic acid halide.

19. The para-aramid fibrid film-like particle of claim 1, wherein the polymerizing of the para-oriented aromatic diamine and the para-oriented aromatic dicarboxylic acid halide to an aramid having at least 95% para-oriented bonds is in a mixture of solvents consisting of N-methylpyrrolidone or dimethylacetamide and calcium chloride or lithium chloride.

* * * * *